US008460035B2

(12) United States Patent
Ueda et al.

(10) Patent No.: US 8,460,035 B2
(45) Date of Patent: Jun. 11, 2013

(54) CONNECTOR ASSEMBLY INCLUDING A CABLE WITH A USB 3.0 SIGNAL LINE, A USB 2.0 SIGNAL LINE, A POWER LINE AND A GROUND LINE

(75) Inventors: Shou Ueda, Sakura (JP); Yoshinori Satoh, Sakura (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 13/156,962

(22) Filed: Jun. 9, 2011

(65) Prior Publication Data

US 2011/0244733 A1 Oct. 6, 2011

Related U.S. Application Data

(63) Continuation of application No. PCT/JP2009/006477, filed on Nov. 30, 2009.

(30) Foreign Application Priority Data

Dec. 17, 2008 (JP) ..... 2008-321099

(51) Int. Cl.
*H01R 24/00* (2011.01)

(52) U.S. Cl.
USPC ..... 439/660

(58) Field of Classification Search
USPC ..... 439/660, 651, 638, 607.01
See application file for complete search history.

(56) References Cited

U.S. PATENT DOCUMENTS

| | | | | |
|---|---|---|---|---|
| 6,765,150 | B2 * | 7/2004 | Hsieh | 174/117 F |
| 7,553,191 | B2 * | 6/2009 | Su et al. | 439/637 |
| 7,758,388 | B2 * | 7/2010 | Xu et al. | 439/651 |
| 8,052,477 | B1 * | 11/2011 | Ko | 439/660 |
| 2003/0064614 | A1 * | 4/2003 | Tanaka et al. | 439/98 |
| 2005/0272303 | A1 | 12/2005 | Wu | |
| 2008/0214054 | A1 | 9/2008 | Su et al. | |
| 2008/0254674 | A1 | 10/2008 | Liao | |
| 2011/0195605 | A1 * | 8/2011 | Zhang et al. | 439/638 |
| 2011/0281468 | A1 * | 11/2011 | Yu et al. | 439/660 |

FOREIGN PATENT DOCUMENTS

| | | | |
|---|---|---|---|
| EP | 1303011 | A1 | 4/2003 |
| JP | 1050422 | A | 2/1998 |
| JP | 3059768 | U | 7/1999 |
| JP | 3071506 | U | 9/2000 |
| JP | 2001-217026 | A | 8/2001 |
| JP | 2002-334615 | A | 11/2002 |
| JP | 200359593 | A | 2/2003 |

(Continued)

OTHER PUBLICATIONS

Communication dated Dec. 6, 2011 from the Japanese Patent Office in counterpart Japanese application No. 2010-517211.

(Continued)

*Primary Examiner* — Chandrika Prasad
(74) *Attorney, Agent, or Firm* — Sughrue Mion, PLLC

(57) ABSTRACT

A plug for a universal serial bus connector in the USB 3.0 standard to which a cable is connected to form a connector assembly, the cable including a signal line for the USB 2.0 standard and a ground line and being fixed by a cable fixing section of a connector shell, the plug includes an electrode which approximately abuts a distal end of the cable fixing section in the connector assembly, and to which at least one of the signal line for the USB 2.0 standard and the ground line is connected.

5 Claims, 4 Drawing Sheets

FOREIGN PATENT DOCUMENTS

| | | | |
|---|---|---|---|
| JP | 2005228629 | A | 8/2005 |
| JP | 2005251681 | A | 9/2005 |
| JP | 2006260850 | A | 9/2006 |
| JP | 2007-141522 | A | 6/2007 |
| JP | 2008-508694 | A | 3/2008 |
| JP | 2008177045 | A | 7/2008 |
| JP | 3147781 | U | 12/2008 |
| WO | 2006/013553 | A2 | 2/2006 |

OTHER PUBLICATIONS

"Universal Serial Bus 3.0 Specification", Internet citation, Nov. 12, 2008, page complete, XP007906852, Retrieved from Internet: URL:http://www.usb.org/developers/dos/[retrieved on Jan. 20, 2009]p. 75.

Supplementary European Search Report Dated Apr. 18, 2012 issued in European Application No. 09833135.8.

* cited by examiner

CONNECTOR ASSEMBLY INCLUDING A CABLE WITH A USB 3.0 SIGNAL LINE, A USB 2.0 SIGNAL LINE, A POWER LINE AND A GROUND LINE

CROSS REFERENCE TO RELATED APPLICATIONS

This application is a continuation application based on a PCT Patent Application No. PCT/JP2009/006477, filed Nov. 30, 2009, whose priority is claimed on Japanese Patent Application No. 2008-321099 filed Dec. 17, 2008, the entire content of which are hereby incorporated by reference.

BACKGROUND OF THE INVENTION

1. Field of the Invention

The present invention relates to plug for a universal serial bus (hereinafter abbreviated as "USB") connector (hereinafter abbreviated as "plug"), and a connector assembly using the plug, and in particular relates to the structure of a Standard-A plug or a Standard-B plug in the USB 3.0 standard.

2. Description of the Related Art

A USB connector is a type of connector that is used for the connection of electronic devices including personal computers and peripheral devices, and is widely used due to having the advantages of easy connection to a device, plug-and-play or hot plugging capability, and capability of being used as a terminal for power supply (refer to Japanese Unexamined Patent Application, First Publication No. 2001-217026, Published Japanese Translation No. 2008-508694 of the PCT International Publication, Japanese Utility Model (Registered) Publication No. 3059768, and http://www.hirose.co.jp/catalogj_hp/j24000019). The specification of the plug that constitutes a USB connector and the receptacle into which the plug is inserted are defined by standards.

On the other hand, in connecting a plug and cable to form a USB connector assembly, the structure of the connection portion is not particularly specified. For example, as shown in FIG. 7, a structure is employed in which a plug 1 is housed in a metal connector shell 2, a jacket 3*a* of a cable 3 is fixed in a grasping manner in a clamp portion 2*a* that is provided at the base end portion of the connector shell 2, and a plurality of electrical wires 3*b* that extend from the distal end of the jacket 3*a* to the distal end side are connected to a plurality of electrodes 1*a* arranged at the base end portion of the plug 1. Also, in the case of the cable 3 used for the USB 3.0 standard, the aforementioned plurality of wires 3*b* consist of two pairs of signal lines for the USB 3.0 standard that are shielded, one pair of wires for the USB 2.0 standard that are not shielded, a power line and a ground line, for a total of eight wires (only five are shown in the figure). Note that in the following disclosure, unless otherwise noted, the left side in the figures (the side to be inserted into a receptacle) shall be defined as the distal end side, and the right side (the side connected to the cable) as the base end side.

In the aforementioned cable 3, the plurality of wires 3*b* are covered from the outer side by a jacket 3*a* and a braid 3*c*. Accordingly, during the connection described above, work called "leading" is required to remove the jacket 3*a* and the braid 3*c* to enable connection of the wires 3*b* to the electrode 1*a* of the plug 1. In the aforementioned conventional connector assembly, the distance between the location where the jacket 3*a* and the braid 3*c* of the cable 3, that is fixed to the clamp portion 2*a*, are removed by leading, and each electrode 1*a* of the USB plug 1 (the distance shown by the letter D in FIG. 7) is substantially equivalent. Accordingly, the lengths of the plurality of (exposed) wires 3*b* that extend from the distal end of the jacket 3*a* and the braid 3*c* to the distal end side by leading are substantially equivalent.

However, when the lengths of the plurality of wires 3*b* in the aforementioned exposed portion are equivalent, in the signal wires for the USB 2.0 standard in which the periphery is not particularly shielded, since the surrounding shield by the braid 3*c* is eliminated, they become more susceptible to external noise. In addition, since the braid 3*c* is eliminated, there is also the problem of the region in which impedance mismatching between the paired signal wires for the USB 2.0 standard occurs expanding. Note that FIG. 7 shows the example of a Standard-A plug in the USB 3.0 standard, but even in the Standard-B plug in the USB 3.0 standard, a similar problem occurs.

The present invention was achieved in view of the aforementioned circumstances, and the object thereof is to provide a plug for a universal serial bus connector and a connector assembly that, in a plug for a USB connector and a connector assembly using the plug, can reduce the effects of external noise that the signal wires for the USB 2.0 standard receive and impedance mismatching between the paired signal wires for the USB 2.0 standard.

SUMMARY

The first aspect of the present invention is a plug for a universal serial bus connector in the USB 3.0 standard to which a cable is connected to form a connector assembly, the cable including a signal line for the USB 2.0 standard and a ground line and being fixed by a cable fixing section of a connector shell, the plug including an electrode which approximately abuts a distal end of the cable fixing section in the connector assembly, and to which at least one of the signal line for the USB 2.0 standard and the ground line is connected.

The second aspect of the present invention is a connector assembly including: the plug for a universal serial bus connector according to claim 1; and the cable that includes the signal line for the USB 2.0 standard, a signal line for the USB 3.0 standard, a power line, and the ground line, wherein the length from a distal end of a jacket of the cable to a distal end of the signal line for the USB 2.0 standard is shorter than the length from the distal end of the jacket to a distal end of the signal line for the USB 3.0 standard.

It may be arranged such that the lengths to the distal end of the signal line for the USB 2.0 standard, the power line, and the ground line with respect to the distal end of the jacket of the cable differ from each other.

The plug for a universal serial bus connector may be a Standard-A plug in the USB 3.0 standard.

The plug for a universal serial bus connector may be a Standard-B plug in the USB 3.0 standard.

According to the present invention, since the signal lines for the USB 2.0 standard that are not shielded can be connected to the electrodes at positions closer to the base end side compared to a conventional plug, it is possible to shorten the overall length of the signal lines for the USB 2.0 standard, which are susceptible to external noise. As a result, the range of being susceptible to external noise of the signal lines for the USB 2.0 standard shortens, and the effect of external noise on the signal lines decreases. Also, since the region where impedance mismatching between the paired signal lines for the USB 2.0 standard occurs (non-shielded region) narrows, the aforementioned impedance mismatching decreases.

DETAILED DESCRIPTION OF THE PREFERRED EMBODIMENTS

[Embodiment 1]

Hereinafter, embodiments of the present invention shall be described with reference to the drawings.

Figure 1:
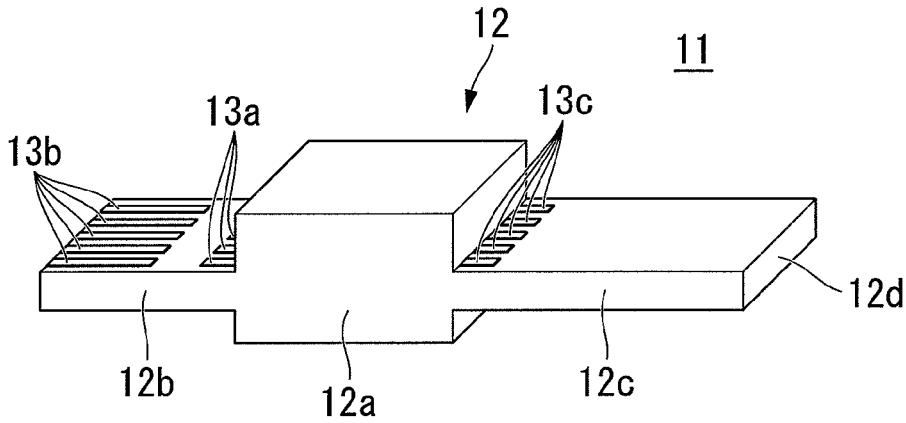
FIG. 1 is perspective view that shows an upper side of an example of the structure of the plug for the USB connector according to the first embodiment of the present invention.
Figure 2:
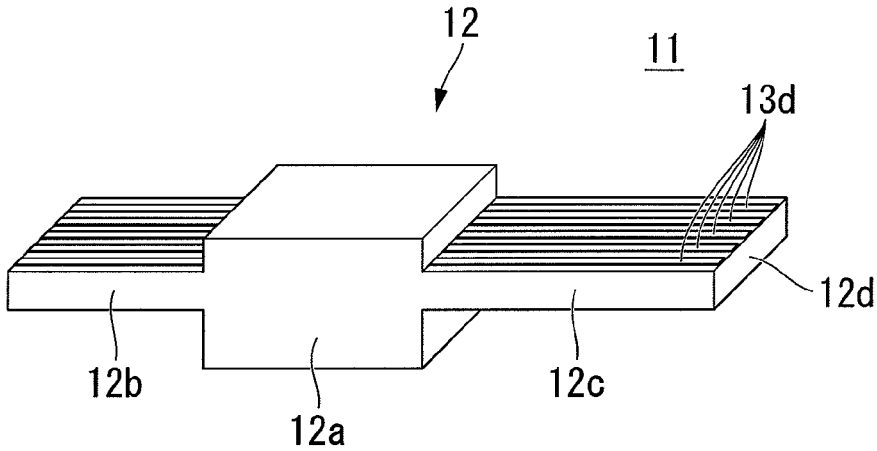
FIG. 2 is perspective view that shows a lower side of an example of the structure of the plug for the USB connector according to the first embodiment of the present invention.

FIG. 1 and FIG. 2 show schematic configurations of a plug 11 for a USB connector according to the first embodiment (Embodiment 1) of the present invention. FIG. 1 is an upper side perspective view that shows the obverse side of the plug 11, and FIG. 2 is a lower side perspective view that shows the reverse side of the plug 11. This plug 11 corresponds to the aforementioned conventional plug 1, and in terms of standards, corresponds to the Standard-A plug in the USB 3.0 standard.

The plug 11 is constituted by a main body 12 that is made of resin, and electrodes 13*a* to 13*d* that are arranged in the main body. The main body 12 is provided with a center portion 12*a* that is supported by a connector shell (refer to reference numeral 2 in FIG. 3 described below) during forming of the connector assembly, a distal end portion 12*b* that extends from the center portion 12*a* to the distal end side and that is inserted into a receptacle (not shown), and a base end portion 12*c* that extends from the center portion 12*a* to the base end side and that is used for connection with a cable described below. Also, the shapes of the center portion 12*a* and the distal end portion 12*b* as well as the arrangement of the electrodes 13*a* to 13*d* in the main body 12 conform to the USB 3.0 standard.

In this plug 11, the constitution of the base end portion 12*c* differs from that of the conventional plug 1. That is, in the plug 11, the base end portion 12*c* extends to a position closer to the base end side compared to the aforementioned conventional plug 1. Specifically, the base end portion 12*c* extends with the same width and same thickness as the conventional plug 1 to a position that approximately abuts the distal end of the clamp portion of the connector shell (refer to reference numeral 2*a* of FIG. 3 described below) during formation of the connector assembly. Here, the "position that approximately abuts the distal end of the clamp portion" means a position at which a base end edge 12*d* of the base end portion 12*c* abuts the distal end face of the clamp portion, or faces it with a slight clearance.

Moreover, the electrodes 13*d* that are positioned on the reverse surface of the base end portion 12*c* (for electrical wire connections in accordance with the USB 2.0 standard) extend to the base end edge 12*d*, along the extension direction of the base end portion 12*c*, in the state of four being arranged at a predetermined interval in the width direction, in contrast to the conventional plug 1. Note that the arrangement of the electrodes 13*a* that are positioned on the obverse base end portion of the distal end portion 12*b* (for receptacle connection in accordance with the USB 3.0 standard) and the electrodes 13*b* positioned on the obverse distal end portion of the distal end portion 12*b* (for receptacle connection in accordance with the USB 2.0 standard), and the electrodes 13*c* positioned on the obverse surface of the base end portion 12*c* (for electrical wire connections in accordance with the USB 3.0 standard) are the same as for the conventional plug 1.

Figure 3:
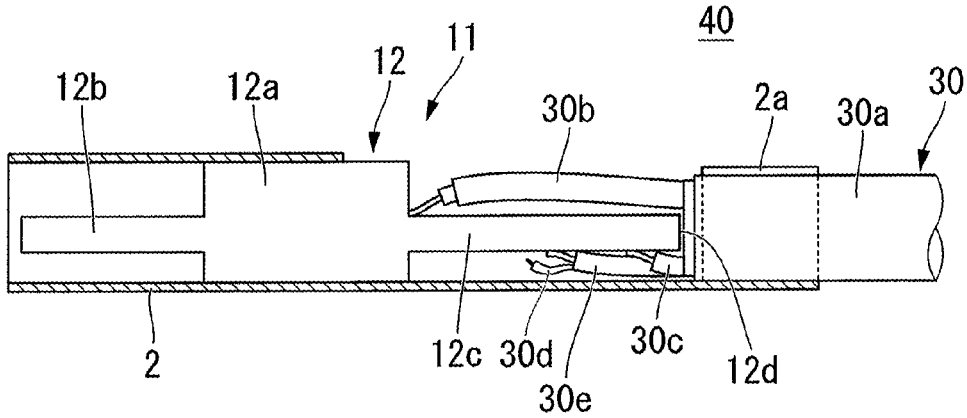
FIG. 3 is a partial cross-sectional view that shows an example of the structure of the connector assembly according to the first embodiment of the present invention.

Then, for example as shown in FIG. 3, the plug 11 is housed in the metal connector shell 2, and the jacket 30*a* of the cable 30 that has been led is fixed in a grasping manner in the clamp portion 2*a* (cable fixing section) that is provided at the base end portion of the connector shell 2. Moreover, the electrodes 13*c* and 13*d* of the plug 11 and the plurality of wires that extend from the distal end of the jacket 30*a* to the distal end side (refer to reference numerals 30*b* to 30*e* described below) are connected. In this way, a connector assembly 40 is formed.

In this case, in the plug 11 of the present embodiment, as stated above, the base end portion 12*c* of the main body 12 extends to a position that approximately abuts the distal end of the clamp portion 2*a* of the connector shell 2 during formation of the connector assembly 40. Also, the electrodes 13*d* that are positioned on the reverse surface of the base end portion 12*c* extend to the base end edge 12*d* along the extension direction of the base end portion 12*c*.

Accordingly, when forming the connector assembly 40, it becomes possible for the paired signal lines 30*c* for the USB 2.0 standard that are not shielded, the power line 30*d*, and the ground line 30*e* to be connected to the electrodes 13*d* at different positions from one another with respect to the extension direction of the base end portion 12*c*. As a result, the length of the two paired signal lines 30*b* for the USB 3.0 standard to be connected to the electrodes 13*c* positioned at the distal end side of the base end portion 12*c*, the length of the electrical wires to be connected to the electrodes 13*d* (the signal lines 30*c*, the power line 30*d* and the ground line 30*e*), as well as the lengths among the electrical wires to be connected to the electrodes 13*d* (the signal lines 30*c*, the power line 30*d* and the ground line 30*e*) can be made to differ with respect to one another.

In particular, since the pair of signal lines 30*c* that are not shielded can be connected to the electrodes 13*d* at positions closer to the base end side compared to the conventional plug 1, it is possible to shorten the overall length of the signal lines 30*c*, which are susceptible to external noise. As a result, the range of being susceptible to external noise of the signal lines 30*c* shortens, and the effect of external noise on the signal lines 30*c* decreases. Also, since the region where impedance mismatching between the paired signal lines 30*c* occurs narrows, the aforementioned impedance mismatching decreases. As a result, reflection of signals between the paired signal lines 30*c*, signal attenuation arising from that, and crosstalk decrease.

[Embodiment 2]

Figure 4:
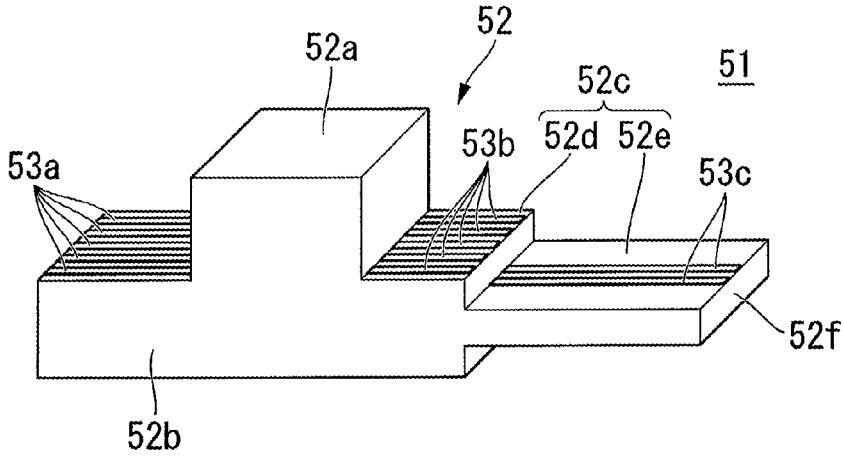
FIG. 4 is perspective view that shows an upper side of an example of the structure of the plug for the USB connector according to the second embodiment of the present invention.
Figure 5:
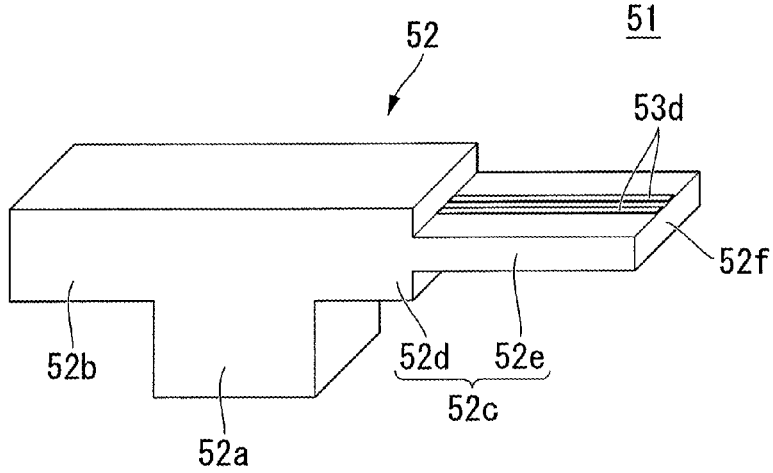
FIG. 5 is perspective view that shows a lower side of an example of the structure of the plug for the USB connector according to the second embodiment of the present invention.

FIG. 4 and FIG. 5 show schematic configurations of a plug 51 for a USB connector according to the second embodiment (Embodiment 2) of the present invention. FIG. 4 is an upper side perspective view that shows the obverse side of the plug 51, and FIG. 5 is a lower side perspective view that shows the reverse side of the plug 51. This plug 51 in terms of standards corresponds to the Standard-B plug in the USB 3.0 standard.

The plug 51 is constituted by a main body 52 that is made of resin, and electrodes 53*a* to 53*d* that are arranged in the main body, similarly to the plug 11 of the aforementioned first embodiment. The main body 52 is provided with a center portion 52*a* that is supported by a connector shell during forming of the connector assembly, a distal end portion 52*b* that extends from the center portion 52*a* to the distal end side and that is inserted into a receptacle (not shown), and a base end portion 52*c* that extends from the center portion 52*a* to the base end side and that is used for connection with a cable. Additionally, the base end portion 52*c* is constituted from a thick base portion 52*d* that is positioned on the distal end side, and a thin end portion 52*e* that extends from the base portion 52*d* to the base end side. The shapes of the center portion 52*a*, the distal end portion 52*b*, and the base portion 52*d* of the base end portion 52*c* as well as the arrangement of the electrodes 53*a* to 53*d* in the main body 52 conform to the USB 3.0 standard.

In this plug 51, the configuration of the end portion 52*e* of the base end portion 52*c* differs from that of the conventional Standard-B plug in the USB 3.0 standard (hereinbelow abbreviated as "conventional plug"). That is, in this plug 51, the end portion 52*e* extends to a position closer to the base end side compared to the conventional plug. Specifically, the end portion 52*e* extends with the same width and same thickness as the end portion of the aforementioned conventional plug to a position that approximately abuts the distal end of the clamp portion of the connector shell (refer to reference numeral 2*a* of FIG. 6 described below) during formation of the connector assembly. Note that the "position that approximately abuts the distal end of the clamp portion" is defined in the same manner as in the plug 11 of the first embodiment described above.

The electrodes shown by the reference numerals 53*c* and 53*d* (for electrical wire connections in accordance with the USB 2.0 standard) extend to the base end edge 52*f*, along the extension direction of the end portion 52*e*, in the state of two each being arranged at a predetermined interval in the width direction on both the obverse and reverse surfaces of the end portion 52*e* of the base end portion 52*c*, in contrast to the conventional plug 1. Note that the arrangement of the electrodes 53*a* that are positioned on the obverse surface of the distal end portion 52*b* (for receptacle connection in accordance with the USB 3.0 standard) and the electrodes positioned on the end surface of the distal end portion 52*b* (for receptacle connection in accordance with the USB 2.0 standard, not illustrated), as well as the electrodes 53*b* positioned on the obverse surface of the base portion 52*d* of the base end portion 52*c* (for electrical wire connections in accordance with the USB 3.0 standard) are the same as for the conventional plug.

Figure 6:
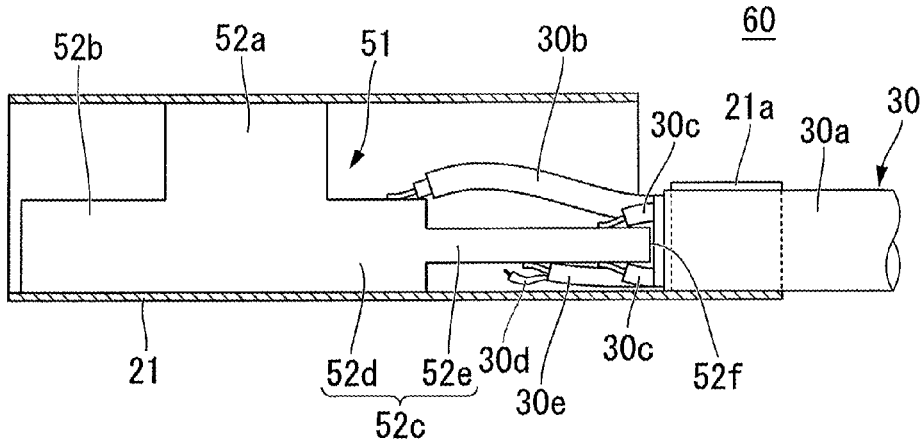
FIG. 6 is a partial cross-sectional view that shows an example of the structure of the connector assembly according to the second embodiment of the present invention.
Figure 7:
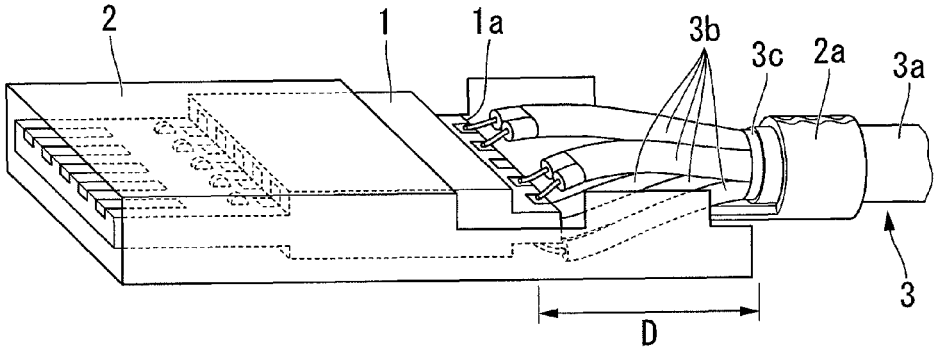
FIG. 7 Prior Art
FIG. 7 is perspective view that shows an upper side of an example of the structure of a conventional connector assembly.

Then, for example as shown in FIG. 6, the plug 51 is housed in the metal connector shell 21, and the jacket 30*a* of the cable 30 that has been led is fixed in a grasping manner in the clamp portion 21*a* (cable fixing means) that is provided at the base end portion of the connector shell 21. Moreover, the electrodes 53*b* to 53*d* of the plug 51 and the plurality of wires that extend from the distal end of the jacket 30*a* to the distal end side (refer to reference numerals 30*b* to 30*e* described below) are connected. In this way, a connector assembly 60 is formed.

In this case, in the plug 51 of the present embodiment, as stated above, among the base end portion 52*c* of the main body 52, the end portion 52*e* that is positioned at the base end side extends to a position that approximately abuts the distal end of the clamp portion 21*a* of the connector shell 21 during formation of the connector assembly 60. Also, the electrodes 53*c* and 53*d* that are positioned on the obverse and reverse surfaces of the end portion 52*e* extend to the base end edge 52*f* along the extension direction of the end portion 52*e*.

Accordingly, when forming the connector assembly 60, it becomes possible for the paired signal lines 30*c* for the USB 2.0 standard that are not shielded, the power line 30*d*, and the ground line 30*e* to be connected to the electrodes 53*c* and 53*d* at different positions from one another with respect to the extension direction of the end portion 52*e*. As a result, the length of the two paired signal lines 30*b* for the USB 3.0 standard to be connected to the electrodes 53*b* positioned at the base portion 52*d* of the base end portion 52*c*, the length of the electrical wires to be connected to the electrodes 53*c* and 53*d* (the signal lines 30*c*, the power line 30*d* and the ground line 30*e*), as well as the lengths among the electrical wires to be connected to the electrodes 53*c* and 53*d* (the signal lines 30*c*, the power line 30*d* and the ground line 30*e*) can be made to differ with respect to one another.

In particular, since the pair of signal lines 30*c* that are not shielded can be connected to the electrodes 53*c*, 53*d* at positions closer to the base end side compared to the conventional plug, it is possible to shorten the overall length of the signal lines 30*c*, which are susceptible to external noise. As a result, the range of being susceptible to external noise of the signal lines 30*c* shortens, and the effect of external noise on the signal lines 30*c* decreases. Also, since the region where impedance mismatching between the paired signal lines 30*c* occurs (non-shielded region) narrows, the aforementioned impedance mismatching decreases. As a result, reflection of signals between the paired signal lines 30*c*, signal attenuation arising from that, and crosstalk decrease.

Note that the technical scope of the present invention is not limited to the foregoing embodiments, and various modifications can be made within a range that does not depart from the scope of the present invention.

For example, in the plugs 11 and 51 of the foregoing embodiments, the electrodes 13*d*, 53*c*, 53*d* for electrical connections in accordance with the USB 2.0 standard all extend to the base end edge 12*d*, 52*f* of the base end portion 12*c*, 52*c*. However, if the object is to shorten the total length of the pair of signal lines 30*c* for the USB 2.0 standard that are not shielded, among the electrodes 13*d*, 53*c*, 53*d*, at least only the electrodes to which the paired signal lines 30*c* for the USB 2.0 standard are connected may be extend to the base end edge 12*d*, 52*f* of the base end portion 12*c*, 52*c*.

What is claimed is:

1. A connector assembly comprising:

a plug for a universal serial bus connector in a USB 3.0 standard; and a cable which is connected to the plug and is fixed by a cable fixing section of a connector shell, the cable comprising a signal line for a USB 2.0 standard, a signal line for the USB 3.0 standard, a power line, a ground line, and a jacket covering the signal line for the USB 2.0 standard, the signal line for the USB 3.0 standard, the power line, and the ground line, wherein the plug comprises a first electrode which approximately abuts a distal end of the cable fixing section, and to which at least one of the signal line for the USB 2.0 standard and the ground line is connected, and wherein a length from a distal end of the jacket of the cable to a distal end of the signal line for the USB 2.0 standard is shorter than a length from the distal end of the jacket to a distal end of the signal line for the USB 3.0 standard.

2. The connector assembly according to claim 1, wherein the plug is a Standard-A plug in the USB 3.0 standard.

3. The connector assembly according to claim 1, wherein the plug is a Standard-B plug in the USB 3.0 standard.

4. The connector assembly according to claim 1, wherein a length of the signal line for the USB 2.0 standard, the power line, and the ground line from a distal end of the jacket of the cable to a distal end of the signal line for the USB 2.0 standard, the power line, and the ground line differ from each other.

5. The connector assembly according to claim 1, wherein the plug comprises a center portion, a distal end side, and a base end portion that extends from the center portion to a base end side such that a base end edge of the base end portion approximately abuts the distal end of the cable fixing section, wherein the first electrode extends to the base end edge along an extension direction of the base end portion and is connected to the signal line for the USB 2.0 standard, and wherein the plug further comprises a second electrode which is positioned at a distal end side of the base end portion and is connected to the signal line for the USB 3.0 standard.

* * * * *